United States Patent [19]

Speigel

[11] 4,316,313

[45] Feb. 23, 1982

[54] METHOD OF FORMING A CATHODE AND INTEGRAL SPACER

[75] Inventor: Kenneth Speigel, Seneca Falls, N.Y.

[73] Assignee: North American Philips Consumer Electronics Corp., New York, N.Y.

[21] Appl. No.: 140,033

[22] Filed: Apr. 14, 1980

[51] Int. Cl.[3] ..... H01J 9/04

[52] U.S. Cl. ..... 29/25.18; 29/25.16

[58] Field of Search ..... 29/25.15, 25.16, 25.14, 29/25.17, 25.18

[56] References Cited

U.S. PATENT DOCUMENTS 2,415,412 2/1947 Buchwald et al. ..... 29/25.16

4,176,432 12/1979 McCandless ..... 29/25.16

FOREIGN PATENT DOCUMENTS 52-31656 3/1977 Japan ..... 29/25.16

*Primary Examiner*—John McQuade

*Attorney, Agent, or Firm*—Thomas A. Briody; Jack Oisher; John C. Fox

[57] ABSTRACT

Critical spacings between the cathode and grid of an electron gun structure are enabled by a cathode structure including a removable spacer, such structure produced by first forming a layer of potentially electron emissive material on the cathode, then forming a solvent drop on the layer, and contacting the drop with a spacer to adhere the spacer to the layer.

5 Claims, 6 Drawing Figures

METHOD OF FORMING A CATHODE AND INTEGRAL SPACER

TECHNICAL FIELD

This invention relates to electron gun cathodes and more particularly to a method of applying a spacer to a cathode whereby the critical spacing requirements between the cathode and control grid of an electron gun can be accurately maintained. Also disclosed are preferred materials for the spacers.

BACKGROUND ART

In an electron gun, the surface of the electron-emissive coating of a cathode is axially positioned relative to a control grid or $G_1$. The cathode is affixed to a tubular eyelet and the eyelet and grid are fixed to and electrically insulated from one another by glass support rods. The electron gun includes also a screen grid or $G_2$ which is spaced from the $G_1$ on the side opposite the cathode.

When the emissive surface of the cathode is positioned too close to the control grid, arcing between the cathode and the control grid may occur, and the cutoff voltage may change. A very small error in the spacing distance, such as 0.001 inch (0.0254 mm) can change the cutoff voltage of the electron gun by about 60 volts.

There are several methods presently in use for establishing cathode-to-grid spacing. In the most common an air probe is inserted through the grid apertures and the cathode is moved toward the probe until a predetermined back pressure, related to spacing, is measured. Other methods have utilized optical, microscopic and capacitance measurements to set spacing. Other methods have used soluble or volatizable spacers which are removed after the desired spacing is achieved or permanent spacers which remain.

Cathode-grid spacings set by permanent spacers can vary from tube to tube because of part and assembly tolerances. Gas flow gages require the insertion of a nozzle through the grid aperture which can damage that aperture. Optical measurements are too slow for production. Spacer materials suggested by the art have been difficult to remove and no adequate method of attaching such a spacer to the potentially emissive material has been disclosed.

Capacitance measurements do not work well when the spacing tolerance is small because the capacitance change being sensed is between the grid and cathode metal and not the emissive surface.

U.S. Pat. No. 4,176,432 discloses a method whereby a non-deformable and a deformable sheet of material, whose total thickness equals the spacing desired, are employed. Cathodes are inserted until they penetrate the deformable strip, then the non-deformable strip is removed and then the deformable strip is removed. This method introduces two different materials whose thickness must be controlled and provides no consistent guidelines for the depth of penetration.

DISCLOSURE OF INVENTION

It is, therefore, an object of the invention to obviate the disadvantages of the prior art.

It is another object of the invention to enhance the spacing between cathode and control grid.

These objects are accomplished, in one aspect of the invention, by the provision of a method for preparing an electron gun cathode for such critical spacing requirements. The method comprises applying a layer of potentially electron emissive material, carried in a selectively soluble binder, to an end of a cathode. A spacer is then prepared, the spacer having a thickness substantially equal to the spacing desired between the control grid and the emissive material surface. The spacer contains at least one component which is selectively soluble.

The layer of potentially electron emissive material is brought into contact with a liquid containing an amount of solvent for the binder and an amount of solvent for the component. Depending on the materials being employed, the solvents may be different or, a single, common solvent may be used. The liquid has a sufficient surface tension so that a drop thereof remains after the emissive material is removed from the liquid. This drop of material is then brought into contact with the spacer, whereby the spacer is picked up and centered on the cathode coating by the liquid, and the solvent or solvents selectively dissolve the interfacing surfaces of the potentially emissive material and the spacer so that, upon drying, the spacer is fastened to the potentially emissive material.

To function properly the spacer must be formed from a material or combination of materials that is solid at normal room temperatures; i.e., 20° C. to 25° C. The spacer must be readily and easily soluble in a solvent that is not harmful to the electron gun components, particularly the cathode coating. By readily and easily soluble is meant a material that can be removed without undue agitation. This is necessary because agitation in the close confines of the cathode-grid environment is very difficult to achieve. The spacer material should also be readily formable, as by molding, to controllable thicknesses, since it is the thickness of the material that will determine the spacing between the cathode and the grid. Also, the spacer, after formation, must be easy to handle and must resist deformation by compressive forces at least up to the limit of the cathode insertion force.

The preferred material for the spacer, which meets all of the above requirements, is substantially pure polyethylene glycol (PEG) having a molecular weight between 950–15,000. Within this range is it preferred to employ a material having an average molecular weight of between 3000 to 3700. Such a material is available from the Union Carbide Corp. under the tradename Carbowax 4000.

This material can be purchased in a granular form which is easily moldable into the desired configuration. After forming it presents the appearance of a waxy material and has good handling qualities. It has a solubility of 62 grams per 100 grams of water and has low hydroscopicity.

Various other materials can be added either singly or in combination to the PEG to change its characteristics if desired. For example, higher molecular weight PEG or polyethylene oxide can be added to increase the strength, although this will decrease the solubility. or, solubility can be further increased by the addition of soluble salts such as potassium acetate.

Additionally, the PEG can be blended with citric acid and ammonium bicarbonate to form spacers with components that react with each other in the presence of water to decompose and thereby disappear from the gun mounts.

Use of these materials and the above described technique provides an economical, and easily reproducible method for attaching spacers to cathodes, which cathodes can subsequently be accurately spaced from a control grid, thus providing an electron gun having an accurately controlled cut-off voltage.

BRIEF DESCRIPTION OF THE DRAWINGS

FIG. 1 represents the step of applying electron emissive material to a cathode;

FIG. 2 represents the cathode coated with the layer of material formed by spraying;

FIG. 3 represents the step of dipping the layer into a solvent to form a solvent drop thereon;

FIG. 4 represents the coated cathode and drop formed by dipping;

FIG. 5 represents the step of contacting a spacer with the solvent drop; and FIG. 6 represents the resultant structure in which the spacer is adhered to the layer of electron emissive material.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
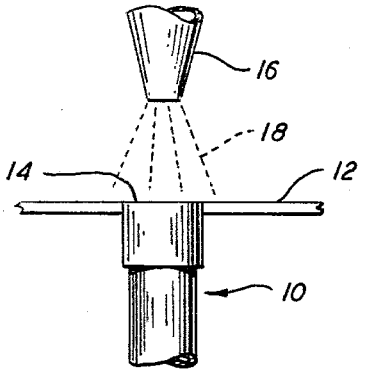
FIGS. 1–6 represent, diagrammatically, the steps employed in the process of the invention.
Figure 2:
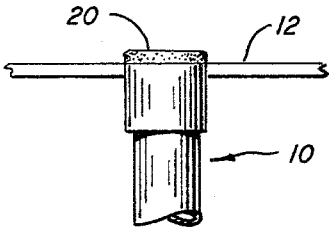
Figure 3:
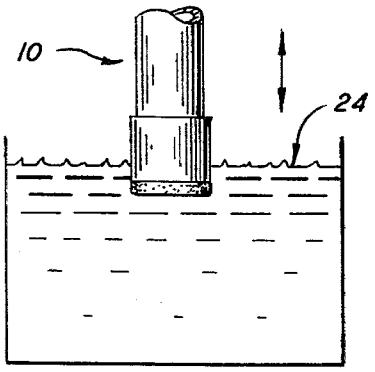
Figure 4:
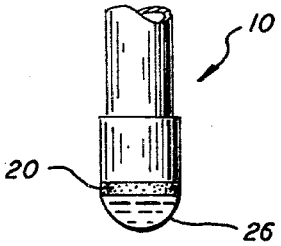

Referring now to the drawings with greater particularity, there is shown in FIG. 1 a cathode 10 mounted in a masking member 12. An end 14 of cathode 10 fits in a suitable aperture in masking member 12. A spray nozzle 16 positioned above the masked cathode dispenses potentially electron emissive material 18 carried in a suitable binder upon the end 14 of cathode 12 to form a layer 20 (FIG. 2). Material 18 can comprise a double carbonate system of barium and strontium or a triple carbonate system further including calcium. Such systems are well known and have been used for many years in the manufacture of oxide cathodes. A typical binder for such a system comprises amyl acetate, nitrocellulose and methyl acetate.

Figure 5:
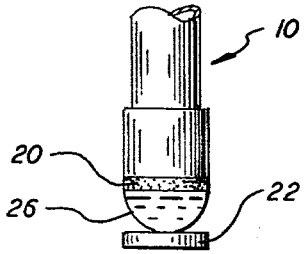
Figure 6:
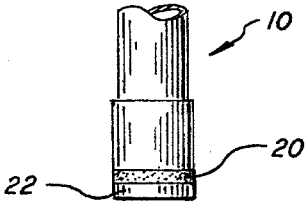

The spacers 22 (FIG. 5) to be attached to the layer 20 are formed from a material which is readily removable, as by dissolution; of a diameter compatable with the cathode 10 and of a thickness substantially equal to the desired spacing distance between cathode 10 and the control grid of the electron gun in which it is to be mounted. As described above a preferred composition for spacer 22 is substantially pure polyethylene glycol having a molecular weight of between 3000–3700, a waxy material which can be formed in a mold to a desired shape and thickness and which is easily dissolved in water.

Whichever material is employed at least one component thereof must be selectively soluble, for reasons to be made clear hereinafter.

To attach the spacer 22 to layer 20, the layer 20 is dipped into a liquid 24 which comprises a solvent for the binder of layer 20 and a solvent for the spacer 22. Generally, the amounts of solvent will be small and the major portion of liquid 24 will be a carrier which is inert relative to the selectively soluble binder and the spacer 22.

For example, and as a preferred form, when layer 20 is formulated as above and spacer 22 is polyethylene glycol, liquid 24 comprises about 78% inert carrier such as isopropyl alcohol, about 15% methyl alcohol which is a solvent for the binder of layer 20, and about 7% deionized water which is a solvent for the polyethylene glycol spacer 22. Other systems are of course possible depending on the materials used for layer 20 and spacer 22.

To apply the spacer 22, layer 20 is dipped into liquid 24 and removed. The surface tension of liquid 24 is such that a drop 26 will remain on layer 20. This drop 26 of liquid 24 is then contacted to spacer 22 and spacer 22 is picked up thereby and centered by surface tension. The solvents contained therein will then selectively dissolve small quantities of the interfacing surfaces and upon drying attach the spacer 22 to layer 20. The assembly is then dried and is available for insertion into an electron gun.

Utilization of this invention provides a simple and economical method of applying a spacer to a cathode. The polyethylene glycol spacer is easily formed and easily dissolved by washing in water, a procedure to which the electron gun is normally subjected, thus resulting in further economies. After the spacer 22 is removed, the electron gun is treated in a normal manner.

While there have been shown and described what are at present considered the preferred embodiments of the invention, it will be obvious to those skilled in the art that various changes and modifications may be made therein without departing from the scope of the invention as defined by the appended claims.

I claim:

1. A method of preparing an electron gun cathode for critical spacing adjacent the control grid of said gun comprising the steps of: applying a layer of a potentially electron emissive material carried in a selectively soluble binder to an end of said cathode; preparing a spacer having a thickness substantially equal to said critical spacing, said spacer containing at least one component which is selectively soluble; contacting said layer of potentially electron emissive material with a liquid containing an amount of solvent for said selectively soluble binder and an amount of solvent for said at least one component, said liquid having a sufficient surface tension so that a drop thereof remains on said potentially electron emissive material; contacting said drop of liquid and said spacer whereby said spacer is picked up by said liquid and said solvents selectively dissolve the interfacing surfaces of said potentially electron emissive material and said spacer and fastens said spacer to said potentially electron emissive material; and drying said drop of liquid.

2. The method of claim 1 wherein said liquid comprises: about 78% of a carrier which is inert relative to said selectively soluble binder and said selectively soluble component and the remainder being a solvent or solvents for said binder and said component.

3. The method of claim 2 wherein said inert carrier is isopropyl alcohol.

4. The method of claim 3 wherein said solvent for said binder is methyl alcohol and said solvent for said component is deionized water.

5. The method of claim 4 wherein said methyl alcohol comprises about 15% of said liquid and said deionized water comprises about 7% of said liquid.

* * * * *